United States Patent [19]

Blume

[11] Patent Number: 4,635,979

[45] Date of Patent: Jan. 13, 1987

[54] LATCH DEVICE FOR RAILCAR HATCH COVERS

[75] Inventor: Orville E. Blume, Buchanan County, Mo.

[73] Assignee: Aero Transportation Products, Inc., Kansas City, Mo.

[21] Appl. No.: 619,582

[22] Filed: Jun. 11, 1984

[51] Int. Cl.[4] ..... E05B 65/18

[52] U.S. Cl. ..... 292/256.5; 220/314

[58] Field of Search ..... 292/256.5, 257, 252, 292/210, 205, 259 R; 105/308 R, 377; 220/314

[56] References Cited

U.S. PATENT DOCUMENTS

| | | | |
|---|---|---|---|
| 759,727 | 5/1904 | Maxwell | 292/257 |
| 797,465 | 8/1905 | Sjoberg | 292/257 |
| 1,245,409 | 11/1917 | Voss | 292/256.5 |
| 1,664,972 | 4/1928 | Dudderar | 292/257 |
| 1,739,911 | 12/1929 | McMurray | 292/257 |
| 2,236,439 | 3/1941 | McKenna | 292/257 X |
| 2,324,356 | 7/1943 | Brown | 292/256 |
| 3,145,665 | 8/1964 | Hamilton | 292/256.5 |
| 3,800,714 | 4/1974 | Stark et al. | 292/256.5 X |
| 3,804,026 | 4/1974 | McNally | 292/210 X |
| 4,063,764 | 12/1977 | Adler | 292/256.5 |
| 4,076,290 | 2/1978 | Sweger | 292/256.5 |
| 4,234,221 | 11/1980 | Przybylinski et al. | 292/256.5 |
| 4,388,873 | 6/1983 | Carleton et al. | 105/377 |

FOREIGN PATENT DOCUMENTS

| | | | |
|---|---|---|---|
| 26511 | 5/1899 | United Kingdom | 292/256.5 |

*Primary Examiner*—Robert L. Wolfe
*Assistant Examiner*—Lloyd A. Gall
*Attorney, Agent, or Firm*—Kokjer, Kircher, Bradley, Wharton, Bowman & Johnson

[57] ABSTRACT

A latch for holding down the hinged hatch covers of railroad hopper cars. A hinge latch plate can be swung out of the way when not in use and is provided with a latch opening for receiving a tongue projecting from the hatch cover. A pivotal latch bar engages the tongue to hold it in the latch opening. The latch bar is shaped and mounted to provide an over center effect requiring it to be swung through a pivot arc greater than 90° before it releases the hatch cover. A heavy duty form of the latch has double latch plates and double latch bars and includes a roller which facilitates the latching and release operations. The latch is useful to hold down the main hatch covers and also porthole hatch covers of the type found on sugar cars.

2 Claims, 8 Drawing Figures

LATCH DEVICE FOR RAILCAR HATCH COVERS

BACKGROUND OF THE INVENTION

This invention relates generally to latch devices and deals more particularly with a latch which is specially constructed to hold down hatch covers of the type found on railroad hopper cars, as well as to latch similar closure panels.

Railroad hopper cars are typically provided with a plurality of hatch covers which serve as doors to open and close the hatches through which materials are loaded into the hopper cars. Railcars commonly known as "sugar" cars have relatively large hatch covers which are in turn each equipped with a number of smaller hatches or portholes. These porthole hatches are covered by small circular hatch covers which open and close on the main hatch covers. The purpose for the porthole hatches is to permit sugar and similar materials to be loaded into the hopper car through spouts which are extended through the small porthole hatches rather than the larger hatches which remain closed. The interior of the hopper car and its contents are thus protected from contamination because dirt and other foreign materials are less likely to be blown into the small round porthole hatches than into the larger main hatches. Of course, the main hatches can be opened to load various other types of materials when contamination is not a particularly serious problem.

Because of the benefits obtained in the loading of sugar cars, the use of small porthole hatches in the larger hatch covers has become rather common. However, the need for additional hatch covers has caused problems. For example, additional latches are required to retain both the large and small hatch covers in the closed position. In the past, latches of the type commonly found on suitcases and briefcases have been used extensively for railcar hatch covers. This type of latch is unduly expensive and is not always easy to manipulate, particularly after it has been in service for an extended period of time. Also, conventional latches are lacking somewhat in reliability and tend to release accidentally when subjected to rough handling and other forces that can be expected in normal service. All of these problems are compounded when additional latches are required such as when additional hatch covers are needed for the porthole hatches of sugar cars.

SUMMARY OF THE INVENTION

The present invention is directed to an improved latch arrangement and has, as its principal goal, the provision of a reliable and low cost latch for holding down the hatch covers of railroad hopper cars, as well as other closure panels.

More specifically, it is an object of the invention to provide a latch device which is able to securely hold down a railcar hatch cover and yet can be easily released when the hatch cover is to be opened. The latch bar which holds down the hatch cover is constructed and mounted in a manner to provide an over center effect which assures that the latch is securely retained in the latching position and will not inadvertently release when subjected to normal forces. The over center arrangement requires the latch bar to be intentionally raised through a pivot arc greater than 90° before it releases the hatch cover. At the same time, initial raising of the latch bar is resisted so that the forces to which the latch is subjected in service do not displace it from the latching position.

Another important object of the invention is to provide a latch device of the character described which is more economical than the types of latches that have been used in the past for railcar hatch covers. The device is constructed in a simple manner and uses parts that are virtually identical to the parts used in the hatch cover hinges in order to provide additional economy.

A further object of the invention is to provide a latch device which can be used both with ordinary hopper car hatch covers and also with the smaller round hatch covers that open and close the porthole hatches of sugar cars. The same latch can be used with either type of hatch cover, and if additional strength is desired for heavy duty service in connection with large hatch covers, a reinforced latch can be used having double latch plates and double latch bars. Moreover, a roller can be incorporated in the latch bar to facilitate latching and release of the bar without detracting from the security with which it holds down the hatch cover.

An additional object of the invention is to provide, in a latch device of the character described, a safety catch which functions to retain the latch bar in place and yet can be released without difficulty to permit raising of the hatch cover.

Another object of the invention is to provide a latch device of the character described which can be secured by a padlock or other lock to prevent unauthorized opening of the hatch cover.

A still further object of the invention is to provide a latch device of the character described which does not obstruct access to or otherwise interfere with the hopper car hatch. When the latch is released, the latch plate is swung well away from the hatch to an out-of-the-way storage position.

Still another object of the invention is to provide a latch device of the character described which functions reliably and can be used with hatch covers that vary widely in style, size and shape.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
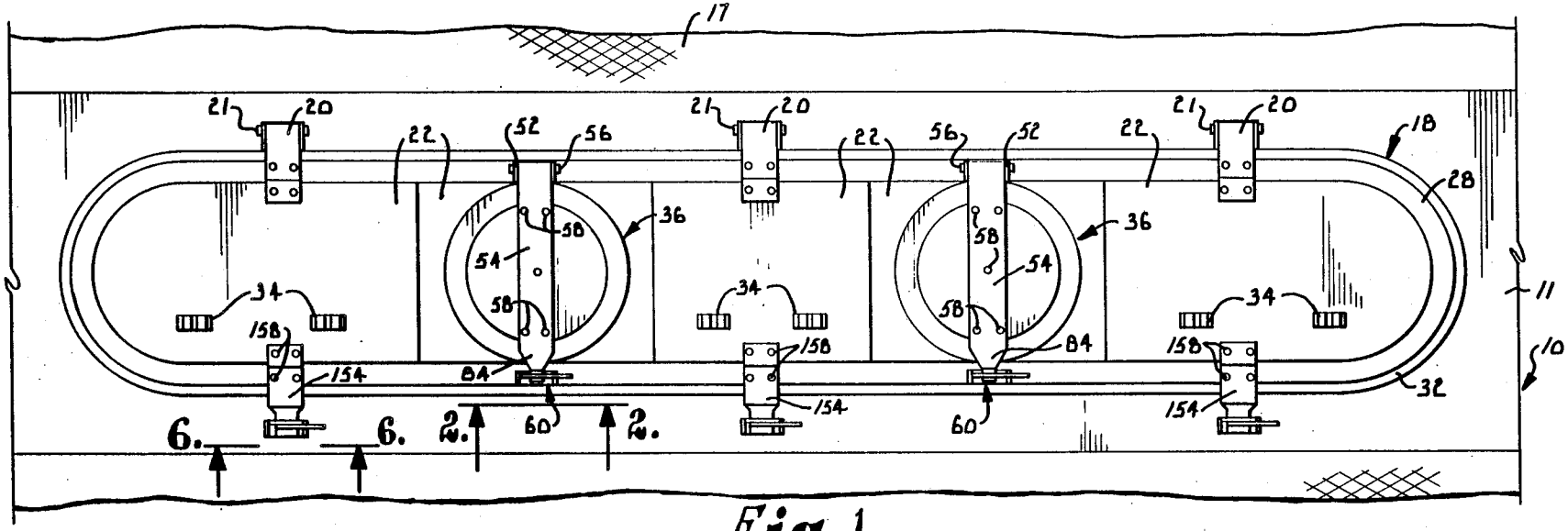
FIG. 1 is a fragmentary top plan view of a railroad hopper car equipped with hatch covers and latches constructed in accordance with the present invention.
Figure 3:
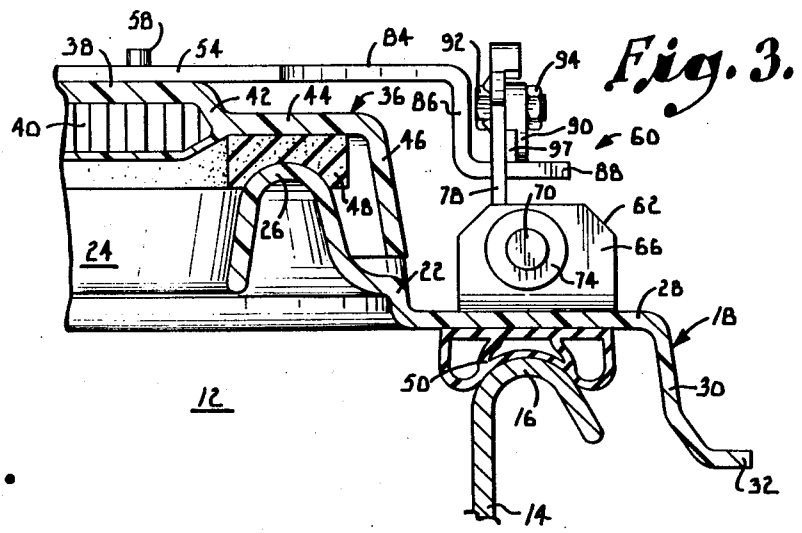
FIG. 3 is a fragmentary sectional view taken generally along line 3—3 of FIG. 2 in the direction of the arrows.

Referring now to the drawings in detail and initially to FIG. 1, numeral 10 generally designates a conventional railway hopper car having a series of openings in its top 11 forming hatches, one of which is designated by numeral 12 in FIG. 3. The hopper car 10 has upstanding flanges 14 which define the sides and ends of the hatches 12. Each flange 14 has a rolled upper edge 16. The hatches 12 provide access for the loading of materials into the hopper car 10. Walkways 17 extend along the top of the hopper car 10 on both sides of the hatches.

Each hatch 12 is opened and closed by a hatch cover generally designated by numeral 18. Each hatch cover 18 is mounted on top of the railcar 10 at a location to cover the adjacent hatch 12. Three hinges 20 connect the hatch cover 18 with the railcar so that the hatch can be opened by raising the hatch cover about the horizontal axis defined by the aligned hinge pins 21 of the hinges.

Each hatch cover 18 is formed by a plurality of connected panels 22. Selected panels 22 are provided with circular porthole hatches 24 (see FIG. 3) which are each bounded by a raised annular rib 26 formed on the panel 22. Extending around the periphery of the main hatch cover 18 is a flat shoulder 28 which is recessed slightly below the main body portions of the panels 22, as best shown in FIG. 3. The outer edge of shoulder 28 is turned downwardly to provide a flange 30 having a horizontal lip 32 turned outwardly from its bottom edge. As best shown in FIG. 1, the top side of the main hatch cover 18 is provided with a plurality of bumpers 34 which protect the panels 22 from damage when the hatch cover is open.

Each porthole hatch 24 is opened and closed by a circular hatch cover 36. As best shown in FIG. 3, each of the hatch covers 36 has a main panel 38 which is circular and provided with honeycomb reinforcement 40 on its underside. A small flange 42 angles downwardly and outwardly from the outer edge of the panel 38. An annular shoulder 44 extends outwardly from the lower edge of flange 42 and connects at its outer edge with a downturned skirt 46 which forms the outer rim of the hatch cover 36. An annular gasket 48 formed of neoprene or a similar compressible material is carried on the underside of the horizontal shoulder 44 to seal against the rib 26, when the hatch cover is closed. Another gasket 50, likewise formed of neoprene or another compressible material, is carried on the underside of shoulder 28 of the large hatch cover 18 to seal against the rolled edge 16 of the hopper car flange 14 when the large hatch cover is closed.

Each porthole hatch cover 36 is connected with the main hatch cover 18 by a hinge 52 mounted on top of the shoulder 28. A rigid metal hinge strap 54 carries a hinge barrel on one end which turns on a horizontal hinge pin 56 forming part of the hinge 52. Hinge strap 54 is secured to the top of the main panel 38 of the hatch cover 36 by suitable fasteners 58.

In accordance with the present invention, each hatch cover 36 is held down in a closed position on its porthole hatch 24 by a latch device generally indicated by numeral 60. With particular reference now to FIGS. 2–5, each latch 60 includes a metal mounting bracket 62 having a flat base 64 and parallel flanges 66 extending upwardly from the opposite ends of the base 64. Bracket 62 is affixed to the main hatch cover 18 by a series of bolts 68 or other fasteners which secure the base 64 on top of the horizontal shoulder 28 of the main hatch cover. The main cover 18 forms a frame surrounding the smaller covers 36, and the bracket 62 is mounted on such frame.

A horizontal hinge pin 70 is inserted through openings formed in the mounting bracket flanges 66 and is secured by a drive on washer 74. Between the flanges 66, a hinge barrel 76 is sleeved around the hinge pin 70 and is able to turn about the axis thereof. Integral therewith and extending from the hinge barrel 76 is a latch plate 78 having a rectangular latch opening 80.

Figures 4, 5, 6, 7, 8:
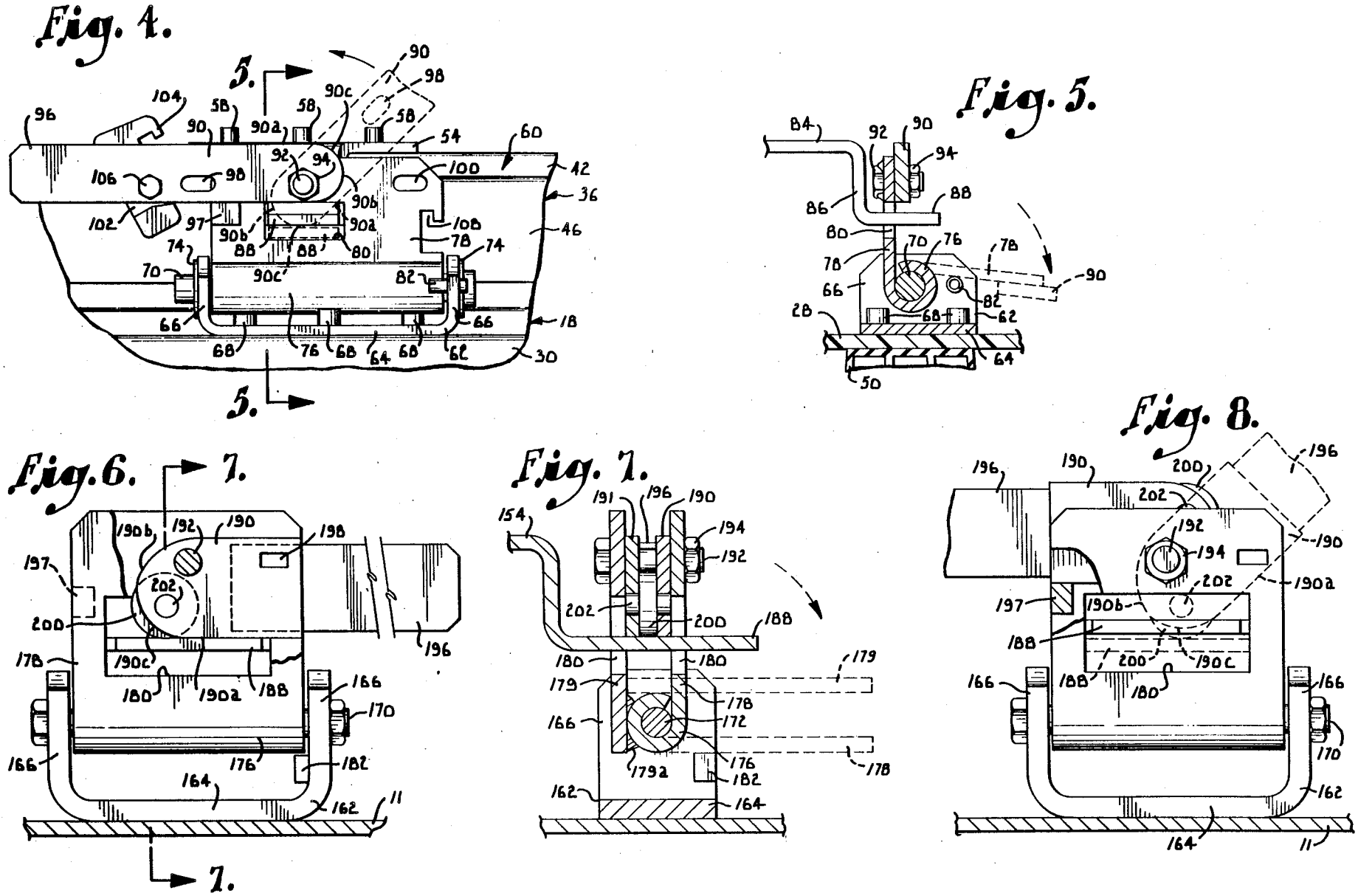
FIG. 4 is a fragmentary side elevational view similar to FIG. 2 but showing the latch in the release position, with the broken lines illustrating the latch bar at an intermediate position between the latching and release positions.
FIG. 5 is a fragmentary sectional view taken generally along line 5—5 of FIG. 4 in the direction of the arrows, with the broken lines illustrating movement of the latch plate to its storage position.
FIG. 6 is a fragmentary side elevational view on an enlarged scale taken generally along line 6—6 of FIG. 1 in the direction of the arrows, with the break lines indicating continuous length of the latch bar handle.
FIG. 7 is a fragmentary sectional view taken generally along line 7—7 of FIG. 6 in the direction of the arrows, with the broken lines illustrating the latch plate in its storage position.
FIG. 8 is a fragmentary elevational view similar to FIG. 6, but with the solid lines showing the latch bar in the release position and the broken lines showing the latch bar in an intermediate position between the latching and release position.

The latch plate 78 is mounted for hinged movement between the vertical operating position shown in solid lines in FIG. 5 and the generally horizontal storage position shown in broken lines in FIG. 5. A pin 82 is secured to one of the flanges 66 at a location to provide a stop which prevents the latch plate 78 from swinging downwardly beyond the broken line position of FIG. 5. In the broken line storage position, the latch plate 78 rests on top of the stop pin 82.

Figure 2:
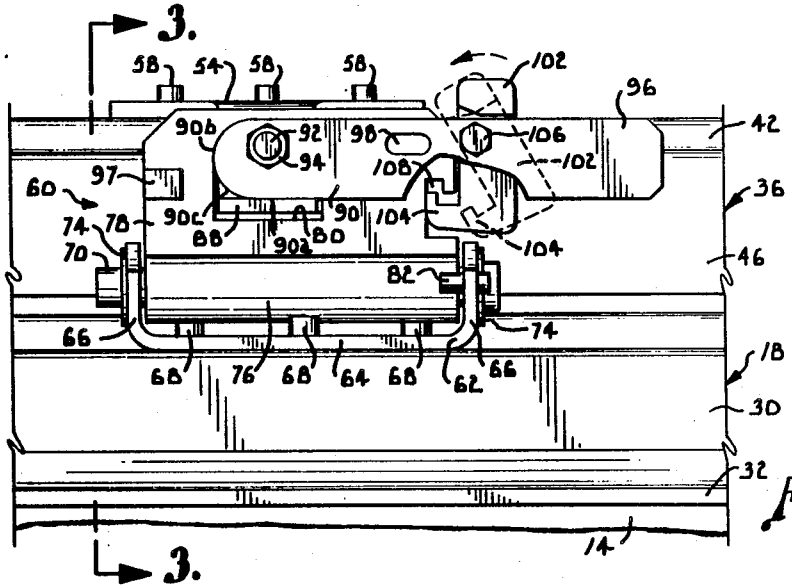
FIG. 2 is a fragmentary side elevational view on an enlarged scale taken generally along line 2—2 of FIG. 1 in the direction of the arrows, with the broken lines illustrating movement of the safety catch to a release position.

The end of the hinge strap 54 has a neck portion 84 which gradually tapers and connects with a vertical leg 86 which extends downwardly from its end. A tongue 88 extends from the lower edge of the vertical leg 86. As best shown in FIG. 2, the tongue 88 has substantially the same width as the latch opening 80 and extends through the latch opening when the hatch cover 36 is closed and the latch plate 78 is raised to its operating position.

The tongue 88 is held in the latch opening 80 by a latch bar 90 which is pivoted to the latch plate 78 by a threaded stud 92 located immediately above the latch opening 80. A nut 94 is threaded onto the stud 92 to secure the latch bar 90 against the outside surface of the latch plate 78. The pivot axis for the latch bar 90 (stud 92) is perpendicular to and offset from the hinge axis for the latch plate 78 (pin 70). The latch bar 90 projects well beyond the latch plate 78 to provide a handle 96 which permits the latch bar to be manually swung about stud 92 between the latching position shown in FIG. 2 and the release position shown in solid lines in FIG. 4. A block 97 is secured to latch plate 78 to provide a stop which prevents the latch bar 90 from swinging beyond the release position.

The latch bar 90 has a straight lower edge 90*a* which provides a latching surface that engages the top of tongue 88 in the latching position of the bar. Stud 92 is located off center on bar 90 well above the longitudinal center line of the bar. The end of bar 90 is rounded to provide a cam surface 90*b* which is eccentric with respect to the off center stud 92. The cam surface 90*b* acts against the top of tongue 88 as the latch bar is swung between the latching and release positions. The cam surface 90*b* has a high point 90*c* which is located further from the stud 92 than the edge 90*a*.

The latch bar 90 has an oval opening 98 which aligns with a similarly shaped opening 100 (see FIG. 4) in the latch plate 78 when the latch bar is in its latching position. A padlock or other lock (not shown) can be extended through the aligned openings 98 and 100 to lock the latching bar in its latching position.

The latch has a safety catch in the form of a catch element 102 having a hook 104 on one end. A pivot bolt 106 connects the catch element 102 with the latch bar 90 at a location on the catch element above center when bar 90 is latched in the position shown in FIG. 2. The catch element thus moves under the influence of gravity to the solid line position of FIG. 2 in which it hangs downwardly from the pivot bolt 106. In this position, the hook 104 mates with a notch 108 formed in one edge of the latch plate 78. The latch bar 90 cannot be raised unless the catch element 102 is first released by manually pivoting it to the broken line position of FIG. 2. When the catch is released, the latch bar 90 can be raised about stud 92 to its release position.

In use, the latches 60 hold the hatch covers 36 down on top of the porthole hatches 24. In the latching position shown in FIG. 2, the lower edge 90*a* of bar 90 serves as a latching surface which presses downwardly on top of the tongue 88 which projects through the latch opening 80 in plate 78. The downward pressure exerted on the hinge strap 54 holds the hatch cover 36 down such that the compressible gasket 48 is pressed downwardly on top of the rib 26 in a partially compressed condition. The hatch opening is thus covered by the hatch cover 36 and sealed by the gasket 48. The force acting between the latch bar 90 and the tongue 88 maintains latch plate 78 in its vertical operating position and prevents it from turning about the hinge pin 70 until the latch bar is released.

The latch bar is released by grasping its handle end 96 and pivoting the catch element 102 to the release position (broken lines in FIG. 2) prior to lifting the latch bar about stud 92. Since the high point 90*c* of cam surface 90*b* is more distant from stud 92 than the latching surface 90*a*, initial raising of the latch bar from its latching position causes tongue 88 to be cammed downwardly, as best shown in broken lines in FIG. 4, thereby further compressing the gasket 48. In this manner, initial movement of the latch bar away from its latching position is resisted, and forces applied to the latch in normal service cannot release it inadvertently. As the latch bar swings past the position in which the high area 90*c* confronts tongue 88, the cam surface 90*b* gradually and progressively releases from the tongue and eventually releases completely from the tongue. The cam surface 90*b* does not push tongue 88 downwardly far enough to cause it to bottom out in the latch opening 80.

Once the latch bar has been swung beyond the vertical position through more than a ninety degree pivot arc, the low portion of the cam surface 90*b* confronts the tongue 88, and the gasket 48 decompresses. In the fully released position shown in solid lines in FIG. 4, the latch bar 90 is located well above tongue 88, and the tongue extends freely through the latch opening 80. The latch plate 78 can then be swung downwardly to the storage position shown in broken lines in FIG. 5. This causes tongue 88 to withdraw from the latch opening 80 so that the hatch cover 36 is released and can be raised about its hinge pin 56 to an open position for loading of the hopper car.

When the loading of sugar or another material has been completed, the hatch cover 36 is lowered to the closed position, and the latch plate 78 is raised until the tongue 88 extends through the latch opening 80. The latch bar 90 is then swung from the release position to the latching position wherein the hatch cover is latched in its closed position covering the porthole latch 24.

The configuration of the cam surface 90*b* resists any tendency for the hatch bar to inadvertently release and requires that the latch bar be intentionally moved to an over center position before it can fully release from the tongue 88. Consequently, the safety catch element 102 is not always necessary and can normally be eliminated, although it provides a desirable safety feature in many instances. Whether or not the latch 102 is provided, the hatch cover can be locked in the closed position by a padlock or other lock extended through the aligned openings 98 and 100.

The main hatch cover 18 is held down in the closed position by three latches 160 which for the most part are similar to the latches 60. The components of latch 160 which are similar to corresponding components of latch 60 are identified by the same numerals preceded by the digit one. The latch 160 differs from latch 60 mainly in its use of two parallel plates in its latch plate construction and two parallel bars in its latch bar.

As best shown in FIG. 7, the latch plate 178 which is integral with the hinge barrel 176 cooperates with an identical and parallel latch plate 179 which is welded at 179*a* to the hinge barrel 176. Plates 178 and 179 have aligned latch openings 180 which receive the tongue 188 formed on the end of a rigid strap 154 which is fastened at 158 to the hatch cover 18 (see FIG. 1).

The mounting bracket 162 is welded to the top 11 of the railcar which forms a frame surrounding the main hatch opening. Bracket 162 has upstanding flanges 166 that are somewhat taller than flanges 66. The base 164 of the bracket 166 is mounted on the top 11 of the hopper car 10 at a location causing the tongue 188 to extend through the latch opening 180 when the hatch cover 18 is closed and the latch plates 178 and 179 are raised to the vertical operating position shown in solid lines in FIG. 7. A block 182 is secured to one of the flanges 166 to provide a stop which prevents the latch plates 178 and 179 from moving beyond the horizontal storage position shown in broken lines in FIG. 7.

A pair of parallel latch bars 190 and 191 are located between the latch plates 178 and 179 and are pivoted thereto by the off center stud 192. The latch bars 190 and 191 are shorter than latch bar 90, and the handle 196 is a separate member which has one end inserted between and secured to the two latch bars.

Because the large hatch cover 18 is considerably bigger than the smaller porthole covers 36, the latch 160 is somewhat harder to engage and release than the latch 60. Accordingly, a roller 200 may be provided on the latch bar assembly of latch 160. The roller 200 is fitted between the two latch bars 190 and 191 and has an axle 202 which fits in openings formed in the two latch bars. Roller 200 is free to turn about the axis provided by its axle 202.

The roller 200 projects outwardly beyond the high area 190*c* of the cam surface 190*b*. Accordingly, when the latch bar is to be initially raised in its latching position, the rolling action provided by the roller facilitates pivoting of the latch bar about stud 192. Similarly, the roller facilitates pivoting of the latch bar as it approaches the latching position. In all other respects, the latch 160 functions in the same manner as does latch 60. In the latching position of the latch 160, gasket 50 is partially compressed on the rolled edge 16 in order to seal the main hatch 12. A safety catch similar to catch 102 can be provided if desired.

Because it serves to hold down the larger hatch cover 18, each latch 160 may require the additional strength provided by the double latch plates 178 and 179 and the double latch bars 190 and 191. Also, the roller 200 is particularly useful in the stronger latch 160, although it is not always necessary for the larger latch and a similar roller can form part of the smaller latch 60 if desired. It is important to note that the hinge arrangement which permits the latch plates 78 and 178 to swing in hinged fashion between the operating and storage positions is similar in construction to the hinges 20 and 52. As a result, similar components (such as the mounting brackets, hinge barrels and hinge straps) can be used both in the hinges and the latches, thereby producing economies resulting from standardization of parts.

It should be understood that in addition to hatch covers, the latch arrangement of the present invention can be used to latch other types of panels closed. In this case, the latch bracket is mounted to the frame which surrounds the opening which is opened and closed by the panel.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A latch device for a railcar hatch cover which closes on a compressible gasket and which has a projecting tongue, said latch device comprising:

a mounting bracket adapted to be mounted on the railcar;

a pair of spaced apart latch plates mounted on said bracket for movement about a generally horizontal hinge axis between an operating position and a storage position, said latch plates presenting an opening located to receive the tongue when the latch cover is closed and said latch plates are moved to the operating position and said latch plates being substantially parallel to one another and being substantially perpendicular to said tongue in the operating position;

a pivotal latch bar mounted on said latch plates for swinging movement between latching and release positions about a pivot axis oriented substantially perpendicular to said hinge axis, said bar having a pair of substantially parallel bar members spaced apart from one another and fitting between said latch plates;

a cam surface on said latch bar confronting the top of the tongues between the latching and release positions of the bar, said cam surface having a high area adjacent a latching surface of said bar to push the tongue down for forcing the cover down on the gasket to compress same beyond a partially compressed condition when said high area confronts the tongue whereby to resist initial movement of the latch bar away from the latching position, said cam surface gradually releasing from the tongue as said bar is swung toward the release position; and a roller mounted between said bar members for rotation at a location to provide said high area of the cam surface.

2. A latch device as set forth in claim 1, including a handle projecting from between said bar members to facilitate swinging of said latch bar between the latching and release positions.

* * * * *